United States Patent [19]

Anderson

[11] Patent Number: 4,810,844

[45] Date of Patent: Mar. 7, 1989

[54] MICROWAVE POPCORN PACKAGE

[76] Inventor: Alan R. Anderson, 707 Pheasant Run, West Chester, Pa. 19382

[21] Appl. No.: 126,366

[22] Filed: Nov. 30, 1987

[51] Int. Cl.[4] ..... B65D 81/34

[52] U.S. Cl. ..... 219/10.55 E; 426/107; 426/109; 426/234; 426/241; 426/242; 206/632; 229/DIG. 3

[58] Field of Search ..... 219/10.55 E, 10.55 F, 219/10.55 M; 426/107–111, 234, 241–243; 206/632; 99/DIG. 14, 323.4, 323.5; 229/DIG. 3

[56] References Cited

U.S. PATENT DOCUMENTS

| | | | |
|---|---|---|---|
| 3,973,045 | 8/1976 | Brandberg et al. | 426/110 |
| 4,038,425 | 7/1977 | Brandberg et al. | 426/107 |
| 4,219,573 | 8/1980 | Borek | 426/107 |
| 4,292,332 | 9/1981 | McHam | 426/111 |
| 4,450,180 | 5/1984 | Watkins | 426/107 |
| 4,461,031 | 7/1984 | Blamer | 383/123 |
| 4,503,559 | 3/1985 | Warnke | 383/40 |
| 4,548,826 | 10/1985 | Watkins | 426/394 |
| 4,553,010 | 11/1985 | Bohrer et al. | 219/10.55 E |
| 4,563,561 | 1/1986 | Vaeth et al. | 219/10.55 E |
| 4,571,337 | 2/1986 | Cage et al. | 426/107 |
| 4,584,202 | 4/1986 | Roccaforte | 426/111 |
| 4,640,838 | 2/1987 | Isakson et al. | 426/107 |
| 4,678,882 | 7/1987 | Bohrer et al. | 219/10.55 E |

*Primary Examiner*—A. D. Pellinen
*Assistant Examiner*—Leon K. Fuller
*Attorney, Agent, or Firm*—Woodcock Washburn Kurtz Mackiewicz & Norris

[57] ABSTRACT

This invention relates to a package for popcorn to be cooked in a microwave oven. The package serves as a package for the unpopped corn, as a container for the corn while it is being popped, and also as a serving container for the popped corn. The package utilizes a bag comprising two opposing side panels and an inwardly pleated bottom panel between said opposing side panels, the outside edges of said side panels being joined to one another and to the outside edges of said inwardly pleated bottom panel, portions of said opposing side panels further being joined to portions of said bottom panel so that the inside surface area of said bottom panel is substantially less than the outside surface area of said bottom panel.

12 Claims, 1 Drawing Sheet

MICROWAVE POPCORN PACKAGE

BACKGROUND OF THE INVENTION

This invention relates to a package of popcorn ready for popping in a microwave oven.

The success of popcorn packaged in containers which can be used directly for popping the popcorn in a microwave oven is evident not only by the steadily increasing sales of such packaged popcorn over the last several years, but also by the proliferation of patents issued in the area.

U.S. Pat. No. 3,973,045, issued to Brandberg et al., discloses a popcorn packaged in a flexible and expandable package such as a gussetted bag formed from paper. The package is sealed to permit internal pressure to develop to expand the bag so that the corn has sufficient space for the increased volume after popping.

U.S. Pat. No. 4,038,425 to Brandberg et al. discloses as a combined popping and shipping package for popcorn a package composed of a dual compartmented container. The first compartment is relatively small and contains the charge of popcorn; the second compartment is larger and provided with pleats, folds or gussets to enable it to expand to hold the popped kernels.

U.S. Pat. No. 4,219,573 to Borek discloses an expandable popcorn bag, one wall of which has a thermal insulating pad associated therewith to improve the popping performance of the popcorn by preventing heat loss from the package to the oven floor.

U.S Pat. No. 4,292,332 to McHam discloses an expansible container for popping popcorn comprising a closed bag of flexible sheet material having its upper side provided with a pattern of weakness that serves as an excess vapor pressure release during the popping and which thereafter serves for convenient opening of the container so that it may be used as a serving tray.

U.S. Pat. Nos. 4,450,180 and 4,548,826 to Watkins disclose a popcorn bag formed from a flexible sheet material of collateral tubular configuration, i.e., comprising two parallel longitudinally extending sections communicating together at the center of the package. Substantially all of the popcorn and fat is placed within one tubular section and the other is maintained free of popcorn. During the popping, the empty tubular section is free to expand as it fills with popcorn.

U.S. Pat. No. 4,461,031 to Blamer discloses a tubular bag for containing and microwave cooking popcorn. The bag has a closed bottom end, the bottom end having a strength against rupture that exceeds the rupture strength of a future closure at the mouth or upper end of the bag.

U.S. Pat. No. 4,503,559 to Warnke discloses a bag designed to facilitate the separation of popcorn from unpopped kernels and providing a convenient bag for holding the popped corn while a person eats it. The bag has an outer bag of fine mesh and an inner bag of coarser mesh through which unpopped corn can pass, thereby separating it from the popped corn.

U.S. Pat. Nos. 4,553,010 and 4,678,882 to Bohrer et al. disclose a microwave popcorn container formed from a single blank, e.g. of paperboard, having a bottom panel coated with a microwave interactive material adding heat to the popcorn to be cooked. The container is configured so that the popcorn kernels placed into it are spaced, on average, no more than the average diameter of one kernel away from the microwave interactive panel.

U.S. Pat. No. 4,571,337 to Cage et al. disclose a bag for cooking popcorn in a microwave oven. The bag has a bottom panel, a top panel, a back panel and inwardly folded gusseted side panels such that the bag can be flattened along the top edge opposite the bottom panel. The top edge seal opens before popping is completed to release steam and prevent the popped corn from becoming too chewy.

U.S. Pat. No. 4,584,202 to Roccaforte discloses a package allowing the popping of popcorn in site within a pouch contained in a carton. The carton has a tear-away portion in its top panel which is removed when the package is put into the microwave oven. The pouch is folded in the carton so that the edges of the folded pouch are disposed beneath the opening formed by removal of the tear-away portion. The top panel of the carton includes marginal constraining portions bounding the opening which constrain the pouch once the popcorn has commenced popping.

Thus, a number of different packages for popcorn, suitable for providing stable storage for the unpopped corn, for containing the corn during popping in a microwave oven, and for use as a serving container for the popped corn, have been developed and have met with success in the marketplace. The need still exists for package configurations which will provide better results for the consumer, both in terms of popping efficiency and a satisfactory tasting product, as well as configurations which can be brought to the consumer at a lower cost than those currently available.

SUMMARY OF THE INVENTION

A new microwave package for popcorn has now been developed. This package utilizes a bag comprising two opposing side panels and an inwardly pleated bottom panel between said opposing side panels, the outside edges of said side panels being joined to one another and to the outside edges of said inwardly pleated bottom panel, portions of said opposing side panels further being joined to portions of said bottom panel so that the inside surface area of said bottom panel is substantially less than the outside surface area of said bottom panel. Edible popcorn ingredients are placed inside the bag, on the inside surface of the bottom panel, thereby enabling the bag to stand upright.

The fact that the inside surface area of the bottom panel is less than the outside surface area of that panel is advantageous. First, it is believed that better popping efficiency is obtained when the popcorn kernels and fat are massed together, rather than spread out, because the greater mass is capable of more efficiently conducting the microwave energy. The relatively small inside surface area of the bottom panel allows the kernels to be concentrated together. At the same time, by virtue of the unique construction of the bag, the upper opening of the bag, through which the edible popcorn ingredients are placed during the packaging process, and through which the popped corn is served after cooking, is quite large, making the packaging and serving processes that much more convenient. The configuration of this invention thus contrasts favorably to the traditional flat-bottomed, side gussetted bag (of the lunch bag type) in which most microwave popcorn is sold at this time. In those bags, the bottom panel may be small, enabling concentration of the popcorn kernels if so desired (although most manufacturers recommend cooking with a side panel of the bag placed downward); however, the top opening is also only as big as that small bottom panel, making filling the bag and serving from it somewhat difficult.

DETAILED DESCRIPTION OF THE INVENTION

This invention will be described in greater detail below in reference to FIGS. 1 to 4.

Figure 1:
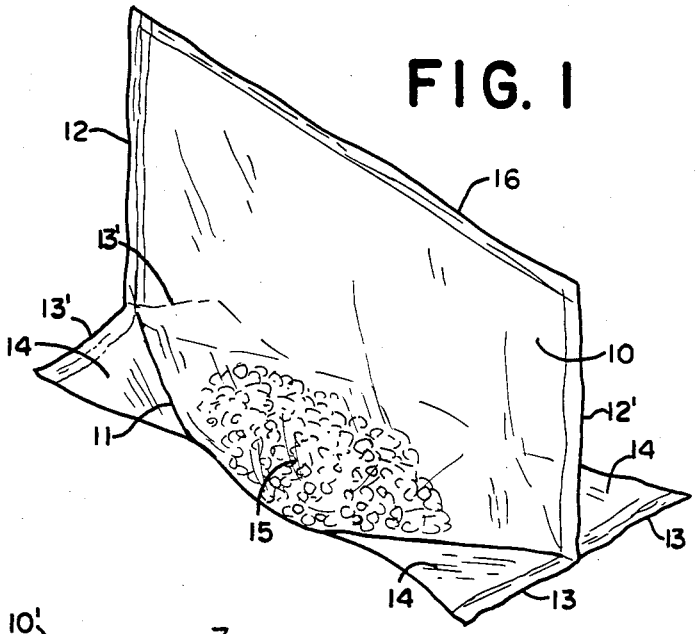
FIG. 1 is a perspective view of a popcorn package according to this invention.
Figure 2:
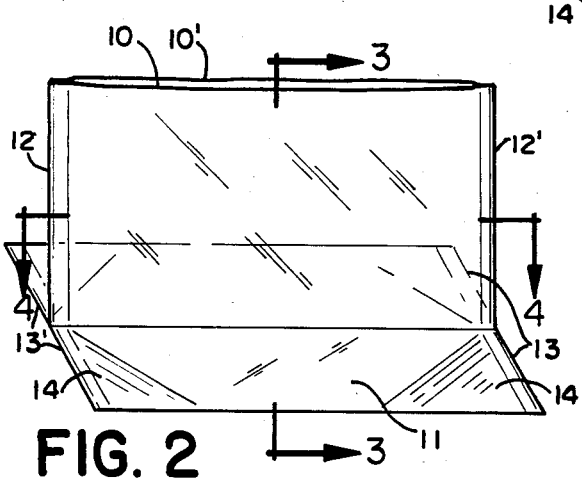
FIG. 2 is a perspective view of a bag of this invention prior to popcorn ingredients being packaged therein.
Figure 3:
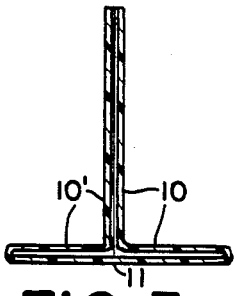
FIG. 3 is a cross-sectional view of the bag of FIG. 2.
Figure 4:
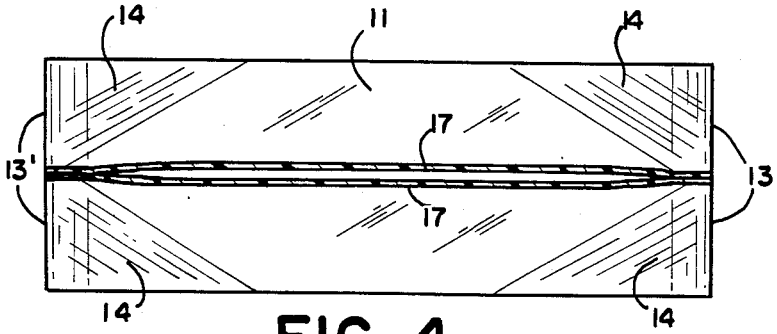
FIG. 4 is a perspective view of the bottom of the bag of FIG. 2.

A popcorn bag constructed in accordance with this invention is illustrated in FIG. 1. In this figure, as well as in FIGS. 2, 3 and 4, the bag is illustrated as being formed from a visible light-transparent material, however, non-transparent materials such as paper may also be utilized. An advantage of the transparent materials is that they allow the consumer to watch the corn inside being popped, cutting down on the chances of under- or over-cooking the popcorn. The material from which the bag is formed must be flexible, substantially transparent to microwave energy and must be able to withstand the high temperatures reached during the microwave cooking of popcorn and oils, e.g., up to about 370° F. The material from which the bag is made is also preferably impervious to the cooking oil or fats packaged with the popcorn. Examples of suitable materials are films of polyesters, such as polyethylene terephthalate, polycarbonates and nylon. An especially preferred film is polyethylene terephthalate film coated on one side with a copolyester that allows for heat sealing. From a packaging standpoint, it is advantageous if the material from which the bag is made provides sufficient water and vapor permeability to allow for a long shelf life of the packaged ingredients. If the bag is not made from such a barrier material as, for example, a paper bag, it may be overwrapped with a barrier material such as a polyethylene terephthalate film to provide barrier protection. The overwrap would be removed by the consumer prior to placing the microwave package in the oven.

Referring to all of the figures, they show a popcorn bag according to this invention having two opposing side panels 10 and 10' connected to a bottom panel 11 having an inward pleat or gusset 17. Side panels 10 and 10' are joined to one another at side seams 12 and 12' and are joined to bottom panel 11 at seams 13 and 13'. To provide for a bottom panel 11 having an inside surface area substantially smaller than its outside surface area, sections of side panels 10 are seamed or bonded to sections of bottom panel 11 in areas 14. As embodied in the specific package illustrated in the figures, the areas 14 are triangular, leaving bottom panel 11 with an inside surface roughly in the shape of a hexagon. To provide a bag in which the inside surface area of the bottom panel is substantially smaller than the outside surface area of said panel, it will generally be desired to join or bond sections of side panels 10 to bottom panel 11 so as to "cut off" the corners of bottom panel 11, as illustrated in the figure. Other means for bonding side panels 10 to bottom panel 11 may also be feasible, however, the only limiting factor being that bottom panel 11 retain a surface area sized and configured so as to permit edible popcorn ingredients to be placed on it.

The inside surface area of bottom panel 11 is substantially smaller than the outside surface area of bottom panel 11 to provide a bag which has an upper opening wide enough to permit easy filling and serving and a bag in the bottom of which the edible popcorn ingredients can be readily massed together for more efficient popping. It is not possible to define the exact extent to which the inside surface area of bottom panel 11 will differ from the outside surface area of said panel, but it is estimated that the inside surface are will generally be about 80 to 93%, preferably about 85%, of the outside surface area of the bottom panel. The bag could be configured so that the inside surface area of the bottom panel is even less than 80% of the outside surface area; however, there are no advantages to such configurations and they tend to waste film or other package material. The differences in surface area will vary according to the shape of the bag and the amount of popcorn placed therein. A typical bag according to this invention may have side panels measuring 7×12 inches, a bottom panel measuring 4×12 inches, corners of the bottom panel being joined to corners of the side panels so that the inside surface area of the bottom panel measures approximately 32 square inches (versus 48 square inches for the outside surface area of the bottom panel). A bag of the size described above would preferably be packed to hold about three to four ounces edible popcorn ingredients (unpopped corn, oil and/or butter, salt).

Edible popcorn ingredients are placed inside the bag, after which the upper edges of side panels 10 and 10' are joined in seam 16. The bag is capable of standing substantially upright, with the popcorn ingredients resting on the inside surface of bottom panel 11. Upon cooking, internal steam pressure in the bag causes the bag to billow and create a space which can be filled by the expanding volume of popped corn. It is preferred that, to prevent heat loss from the package to the oven floor, the package be placed on some sort of insulating panel, e.g. a paper towel or napkin.

Side panels 10 and 10' are preferably joined to each other and to bottom panel 11 by means of heat sealing, however suitable FDA-approved adhesives may also be used. If the seams are to be made by heat sealing, the interior surface of the film or paper from which the bag is made, or at least the area of the seams, is coated with a coating sensitive to a combination of heat and pressure, commonly referred to as a heat seal coating. The seam 16 used to join side panels 10 and 10' at their upper edges is preferably the most easily separated film-to-film seam, making it easy for the consumer to open the bag after cooking by pulling side panels 10 and 10' apart at their upper edges. Although the seam 16 may be made to remain closed throughout the entire popping process, it is advantageous that it open at least partially during the last part of the cooking process to allow steam to escape. Otherwise, steam in the bag can cause the popcorn to become undesirably chewy. Seam 16 can be specially configured to allow such vapor pressure release by applying the heat seal or a water-sensitive adhesive (e.g., a polyvinyl alcohol adhesive) in a pattern which provides weak spots.

In a preferred embodiment of this invention, a microwave interactive material capable of converting a portion of the incident microwave energy to heat is placed inside the bag to increase popping efficiency. Examples of suitable microwave interactive materials are known in the art, e.g., U.S. Pat. No. 4,190,757 to Turpin et al., U.S. Pat. No. 3,783,220 to Tanizaki, U.S. Pat. No. 4,290,924 to Brastad et al. (DBE to check patent #), and U.S. Pat. No. 4,283,427 to Winters et al. For use in this invention, the preferred microwave interactive material is lightly metallized polyethylene terephthalate film which can be laminated to Kraft paper or paper board and placed, metallized surface up, on the inside surface of bottom panel 11. A problem with microwave-popped popcorn has been the high percentage of unpopped kernels remaining after cooking. The microwave interactive panel, by absorbing a portion of the microwave energy and converting it to heat, is a heat source which will provide for greater popping efficiency.

Another advantage of the package configuration of this invention is the ease with which the bags may be made and filled. A continuous web of material, such as the aforementioned polyethylene terephthalate film coated with a heat and pressure sensitive material, is folded longitudinally to create an inwardly directed pleat or gusset. At this point, a cross-sectional view of the web of material would show a W-shaped configuration. Heat and pressure are applied to the web at appropriate intervals to create heat seals between opposite panels of the web. The heat seals are configured so as to create a continuous length of bags, having side seams 12 and 12', bottom seams 13 and 13' and sealed areas 14 as described above, and joined to one another at adjacent side seams. The optional microwave interactive material is next placed on the inside bottom panel of each bag, followed by edible popcorn ingredients. Heat and pressure are again applied to seal the top edges of the line of bags, creating seam 16, and the bags are separated.

What is claimed is:

1. A combination of a bag and a mixture of edible popcorn ingredients for popping in said bag in a microwave oven, said combination comprising a bag comprising two opposing side panels and an inwardly pleated bottom panel between said opposing side panels, the outside edges of said side panels being joined to one another and to the outside edges of said inwardly pleated bottom panel, portions of said opposing side panels further being joined to portions of said bottom panel so that the inside surface area of said bottom panel is substantially less than the outside surface area of said bottom panel; said panels comprising a material substantially transparent to microwave energy and capable of withstanding temperatures reached during the microwave cooking of said popcorn ingredients; said edible popcorn ingredients being placed on the inside surface of said bottom panel.

2. The combination of claim 1 in which said panels comprise a material which is substantially transparent to visible light.

3. The combination of claim 2 in which said material is a film of a material selected from polyesters, polycarbonates and nylon.

4. The combination of claim 3 in which said material is a polyethylene terephthalate film.

5. The combination of claim 1 in which said panels comprise paper.

6. The combination of claim 1 in which the inside surface area of said bottom panel is about 80 to 93% smaller than the outside surface area of said panel.

7. The combination of claim 1 in which said side panels are joined together in seals, a portion of which open during cooking of said popcorn to allow for venting of steam.

8. The combination of claim 1 in which a microwave interactive material is placed on the inside surface of said bottom panel.

9. The combination of claim 8 in which said microwave interactive material is a lightly metallized film laminated to paper.

10. The combination of claim 9 where said metal is aluminum.

11. The combination of claim 8 in which the area of said microwave interactive material is large enough so that substantially all edible popcorn ingredients may be situated thereon.

12. The combination of claim 1 in which said side panels are joined to one another and to said bottom panel by heat seals.

* * * * *